United States Patent [19]

Sturwold

[11] Patent Number: 4,885,104

[45] Date of Patent: Dec. 5, 1989

[54] METALWORKING LUBRICANTS DERIVED FROM NATURAL FATS AND OILS

[75] Inventor: Robert J. Sturwold, Cincinnati, Ohio

[73] Assignee: Cincinnati-Vulcan Company, Cincinnati, Ohio

[21] Appl. No.: 239,673

[22] Filed: Sep. 2, 1988

[51] Int. Cl.[4] ..... C10M 129/78

[52] U.S. Cl. ..... 252/48.4; 252/48.6; 252/49.3; 252/49.5; 252/54.6; 252/56 R; 252/56 S; 252/56 D; 72/42

[58] Field of Search ..... 252/56 R, 49.3, 56 D, 252/56 S, 54.6, 48.4, 48.6, 49.5

[56] References Cited

U.S. PATENT DOCUMENTS 3,634,245 1/1972 Meisters ..... 252/49.3

3,928,401 12/1975 Sturwold et al. ..... 252/49.3

4,067,817 1/1978 Sturwold ..... 252/49.3

4,783,274 11/1988 Jokinen et al. ..... 252/56 R

*Primary Examiner*—William R. Dixon, Jr.

*Assistant Examiner*—E. McAvoy

[57] ABSTRACT

Improved metalworking lubricants derived from natural fats and oils and obtained by reacting the natural fat or oil with a hindered polyol and a dicarboxylic acid are provided. These lubricants may be chlorinated, sulfurized or chlorosulfurized. Also disclosed are compositions useful for a variety of metalworking applications wherein the modified triglyceride is blended with conventional triglycerides and/or hydrocarbon oils and which may additionally contain emulsifiers and additives.

28 Claims, No Drawings

METALWORKING LUBRICANTS DERIVED FROM NATURAL FATS AND OILS

BACKGROUND OF THE INVENTION

1. Field of the Invention:

The present invention relates to improved lubricants useful for a variety of metalworking applications obtained by prereacting a natural fat or oil with a hindered polyol and a dicarboxylic acid.

2. Description of the Prior Art:

Metalworking lubricants based on natural fats and oils (triglycerides) are well known in the art and utilized throughout the industry for a variety of processes including rolling, stamping, drawing, pickling, cutting and extruding. Aqueous formulations of natural fats and oils are widely used as the rolling oil in the cold rolling of steel to provide lubrication and cool the rolls.

In addition to providing effective lubrication and effective cooling of the workpiece/working elements, there are other criteria which must be met by metalworking lubricants. Rolling oils, for example, must be capable of providing a continuous coating on the surface of the metal. Furthermore, this coating or film must have a minimum thickness and must be substantive enough to the metal so that it will be maintained at the high pressures which occur in the roll bite. Above and beyond these lubrication considerations it is particularly advantageous if the rolling oil provides some measure of corrosion protection to the rolled strip and burns off cleanly during the annealing operation. Most cold rolled strip is annealed by heating at about 1300° F. in a reducing atmosphere to relieve internal stresses built up during the prior working operations and to give the finished steel the desired physical properties. Residual rolling oil must volatilize cleanly and should not leave any carbonaceous deposits or surface discoloration.

In view of variations in the metals being worked and the different operating conditions and application methods employed, numerous metalworking oils based on natural fats and oils have been developed in an attempt to obtain the optimum balance of properties. Most of these variations have involved the use of different fats and oils or replacement of a portion of the fat or oil with a petroleum product, e.g. mineral oil, or a synthetic lubricant, e.g. a synthetic hydrocarbon or ester. Emulsifier systems have also been widely varied and additives have been employed to enhance the characteristics of these oils.

To a lesser extent the natural fats and oils have been chemically modified to alter their properties. U.S. Pat. No. 3,202,607 discloses the ethoxylation of castor oil and their use in aqueous dispersions for metalworking. In British Pat. No. 847,517 two moles triglyceride and one mole polyethylene glycol are interesterified to produce useful products which are mixtures of mono-, di-, and triglycerides and mono- and diesters of polyethylene glycol. Products useful for resolving water-in-oil emulsions which are the reaction product of castor oil with a polyalkylene glycol and an organic dicarboxy acid, such as diglycolic acid or phthalic anhydride, are disclosed in U.S. Pat. No. 2,925,429. U.S. Pat. No. 2,971,923 discloses similar products for breaking petroleum emulsions and desalting mineral oils.

U.S. Pat. No. 3,720,695 discloses ester lubricants which have a wide variety of uses obtained by first transesterifying castor oil with polyoxyethylene glycol of molecular weight greater than 1000, and then, in a separate and distinct step, esterifying the available hydroxyl groups with a mono- or dicarboxylic acid.

Mixed ester products having significantly improved water solubility are disclosed in U.S. Pat. Nos. 3,634,245 and 3,928,401. The mixed esters are obtained by reacting a triglyceride with a short-chain mono- or dicarboxylic acid and a low molecular weight polyoxyethylene glycol in a single-step operation. Mixed ester products which are readily emulsifiable with water and useful as metalworking fluids, obtained by treating a triglyceride under transesterification conditions with a polyoxyalkylene glycol and a high molecular weight dicarboxylic acid, such as a polymeric fatty acid, are disclosed in U.S. Pat. No. 4,067,817. Blends of the mixed ester with hydrocarbon oils, e.g. mineral oil, are described in U.S. Pat. No. 4,108,785.

Whereas numerous metalworking lubricants based on both unmodified and modified triglycerides have been developed, there is a continuing need for new products. This is particularly so where the new products present economic advantages and/or performance advantages. Performance advantages can include greater latitude in the ability to effectively formulate the lubricant. It can also include improvement in one or more of the properties of the lubricant. It is particularly effective if these improvements are achieved without adversly affecting the other essential properties of the lubricant.

SUMMARY OF THE INVENTION

I have now discovered improved metalworking lubricants derived from natural fats and oils. These lubricants are obtained by prereacting specific triglycerides with a hindered polyol and a dicarboxylic acid. The products of this invention can be used neat, in solution with a suitable solvent or carrier, or in aqueous systems as dispersions or emulsions and are useful for a variety of metalworking operations. The lubricants are particularly useful in aqueous systems as rolling oils for both ferrous and non-ferrous metals. The prereacted triglycerides may also be chlorinated, sulfurized or chlorosulfurized.

By prereacting the triglyceride it is possible to increase the molecular weight so that higher viscosity lubricants are produced. This is desirable since improved lubricity generally results from increases in viscosity. The saponification value of the product is also increased by prereacting which also is generally associated with increased polarity and therefore improved lubricity. All of this is accomplished without adversely affecting burn off during annealing. In fact, I have quite unexpectedly discovered that in most cases the volatility of the prereacted natural fats and oils is superior to that of the unmodified triglyceride so that improved burn off during annealing is often realized. This is contrary to what one would normally expect when the viscosity viz. molecular weight of a product is increased.

More specifically the invention relates to an improved metalworking lubricant having an acid value of 20 or less and hydroxyl value of about 25 or less comprising the reaction product of (a) one equivalent of a natural fat or oil having an iodine value from 5 to 150, a saponification value from 170 to 265 and which is substantially free of hydroxy or keto functionality; (b) 0.1 to 2 equivalents of a hindered polyol having from 5 to 15 carbon atoms and 2 to 8 hydroxyl groups; and (c) 0.1 to 2 equivalents of a dicarboxylic acid having from 2 to 36 carbon atoms or a lower alkyl ester thereof. Improved metalworking lubricants which are chlorinated, sulfurized, or chlorosulfurized to chlorine and/or sulfur contents of from 2% to 20% are also included in the invention.

The invention also encompasses lubricant compositions containing 0.1% to 99.9% of the above-described natural fat or oil which has been reacted with a hindered polyol and dicarboxylic acid and 0.1% to 99.9% of a natural fat, natural oil, or hydrocarbon oil such as a paraffinic or naphthenic oil having a viscosity up to 1000 SUS at 100° F.

The above-defined metalworking lubricants and blends of said lubricants with conventional triglycerides and/or hydrocarbon oils are also combined with suitable emulsifiers and additives to provide effective lubricants for use in aqueous systems. Emulsifier levels can range from 0.1% to 15% and can consist of a single emulsifier or a combination of two or more emulsifiers. Nonionic and cationic emulsifiers or combinations thereof are particularly useful. Additive levels can range from 0.1% to 20%. Formulated lubricant compositions of this type are typically combined with water at 0.5% to 25% level to produce aqueous emulsions or dispersions suitable as rolling oils or the like.

A process is also provided for increasing the lubricity of a natural fat or oil.

DETAILED DESCRIPTION OF THE INVENTION

The improved metalworking lubricants of the present invention are obtained by prereacting a natural fat or oil with a hindered polyol and a dicarboxylic acid. While the exact composition of the product resulting from the prereaction of the triglyceride with the hindered polyol and dicarboxylic acid is not known, it is a complex mixture of a variety of ester products resulting from interchange and condensation reactions.

Natural fats and oils which can be used to obtain the improved lubricants of this invention are those which have iodine values (IV) from 5 to 150 and saponification values (SV) from 170 to 265 and which are substantially free of hydroxy and keto functionality. A single triglyceride or a mixture of two or more triglycerides can be used. When a mixture of triglycerides is employed, it is not necessary that each triglyceride conforms to the IV and SV requirements so long as the IV and SV of the mixture falls within the specified ranges. As employed herein, the terms triglyceride and natural fat and natural oil are used interchangeably. In a particularly useful embodiment of the invention the IV of the triglyceride will range from 10 to 130 and the SV will range from 175 to 210. Triglycerides which contain substantial amounts of hydroxy and keto functionality, i.e. derived from acids such as ricinoleic acid and α-licanic acid, are not suitable.

The following natural fats and oils are representative of those which can be advantageously used, alone or in combination, for the preparation of the improved lubricants of the invention:

| | IV | SV |
|---|---|---|
| White Grease | 58–68 | 190–200 |
| Tallow | 38–48 | 193–200 |
| Mutton | 35–45 | 193–197 |
| Canola | 94–126 | 186–198 |
| Palm | 44–56 | 196–205 |
| Palm Kernel | 14–23 | 245–255 |

-continued

| | IV | SV |
|---|---|---|
| Peanut | 85–95 | 189–193 |
| Olive | 79–88 | 189–195 |
| Neatsfoot | 65–75 | 192–193 |
| Cottonseed | 105–115 | 191–196 |
| Rapeseed | 97–115 | 170–180 |
| Sesame | 103–115 | 188–193 |
| Soybean | 125–140 | 191–194 |

It should be noted that the iodine and saponification values listed above are typical ranges and may vary depending on the source of the fat or oil. IV's are determined in accordance with A.O.C.S. Test Method Tg la-64 and SV's are determined in accordance with A.O.C.S. Test Method Tl la-64T.

Particularly useful fats and oils will have an IV in the range 10 to 130 and will have an SV in the range 175 to 210. It is even more advantageous if the total polyunsaturates content of the fat or oil is 40% or less and if the amount polyunsaturates with 3 or more double bonds is 5% or less. In a particularly useful embodiment of the invention the fat or oil is selected from white grease, tallow, lard, canola oil, palm oil, palm kernel oil, peanut oil, olive oil, neatsfoot oil and cottonseed oil.

A hindered polyol is one of the components which is prereacted with the triglyceride. As employed herein the term hindered polyol is understood to include diols and polyols which contain no hydrogen on the beta-carbon. Hindered polyols useful for the invention contain from 5 to 15 carbon atoms and can have from 2 to 8 hydroxyl groups. Illustrative hindered polyols include neopentyl glycol, trimethyol ethane, trimethylol propane, pentaerythritol, dipentaerythritol, tripentaerythritol, and the like. Mixtures of two or more of these polyols may also be employed. In a particularly useful embodiment the hindered polyol will contain 5 to 6 carbon atoms and have 2 to 4 hydroxyl groups or will be a polyol mixture wherein the predominant polyols have 5 or 6 carbon atoms and 2 to 4 hydroxyl groups.

Necessarily included with the hindered polyol for the prereaction of the natural fat or oil is one or more dicarboxylic acids having from 2 to 36 carbon atoms. The dicarboxylic acid can be cyclic or acyclic. It should also be understood that compounds, such as lower alkyl ($C_{1-4}$) esters and anhydrides, which are functionally equivalent to carboxylic acids under the reaction conditions employed can also be used. Methyl esters of the dicarboxylic acids are particularly notable in this regard. Representative dicarboxylic acids include but are not limited to oxalic acid, malonic acid, succinic acid, glutaric acid, adipic acid, pimelic acid, 2-ethylhexanedioic acid, cyclohexanedicarboxylic acid, azelaic acid, sebacic acid, dodecanedioic acid, heptadecane-1, 8-dicarboxylic acid, heptadecane-1,9-dicarboxylic acid, dimer acid, and the like. Mixtures of one or more of these acids are equally effective.

Dicarboxylic acids used to prereact the natural fat or oil are readily available and can be obtained from any of the numerous industrial processes known to the industry for their production. For example, mixtures of short-chain aliphatic dicarboxylic acids and more usually methyl esters thereof wherein the predominant acids typically contain 4 to 6 carbon atoms are obtained from the manufacture of adipic acid. The mixed acid co-product stream is esterified to refine the co-product. The refined methyl esters may then be separated by fractional distillation. The dicarboxylic acids can be obtained by the oxidation of hydrocarbons for example, by ozonolysis of unsaturated hydrocarbons or other di- or multiolefinic materials or they may be obtained from the catalytic oxidation of saturated and/or unsaturated hydrocarbons. Suitable dicarboxylic acids can also be obtained by oxidation of methyl- or formyl-branched acids such as isostearic acid or formyl-stearic acid. Carboxystearic acids such as heptadecane-1,8-dicarboxylic acid and heptadecane-1,9-dicarboxylic acid as well as other isomeric acids are produced in this manner. Useful dicarboxylic acids can also be obtained by the addition of acrylic acid or methacrylic acid to a monobasic acid containing conjugated unsaturation (e.g. linoleic acid). When linoleic acid (9,11-octadecadienoic acid) and acrylic acid are reacted a dibasic acid of the formula

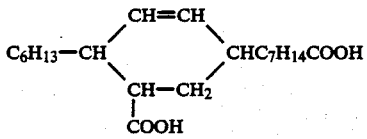

is obtained.

Useful dicarboxylic acids for the invention are also produced by the polymerization (dimerization) of unsaturated monocarboxylic acids containing from 6 to 26 carbon atoms, such as oleic acid, linoleic acid, ricinoleic acid, linolenic acid and eleostearic acid. Dicarboxylic acids produced in this manner, i.e. when two moles of the unsaturated monocarboxylic acid are combined, are referred to as dimer acids. Processes for producing these dimer acids are well known to the prior art and by way of illustration reference may be had to U.S. Pat. Nos. 2,793,219 and 2,955,121. Dimer acids obtained from the dimerization of $C_{18}$ acids, such as oleic acid, linoleic acid and mixtures thereof (e.g. tall oil fatty acids), are especially common. Such dimer acids have as their principal component $C_{36}$ dicarboxylic acid and generally have an acid value in the range 180 to 215, saponification value of about 190 to 205 and neutral equivalent of about 265 to 310. Dimer acids containing less than 25 weight percent by-product acids including monobasic acid, trimer acid or higher polymer acids are particularly useful. The dimer acids can be hydrogenated prior to use if desired.

In an especially useful embodiment of the invention an acyclic (aliphatic) dicarboxylic acid having 2 to 12 carbon atoms or a mixture of these acids is employed with the hindered polyol to prereact with the triglyceride. In yet another embodiment methyl esters of these acids are employed. It is even more advantageous when the aliphatic dicarboxylic acids or methyl esters contain 4 to 10 carbon atoms or if mixtures of said acids/esters are employed that the predominant acids present in the mixture contain 4 to 10 carbon atoms.

Wide variation is possible in the ratio of the triglyceride, hindered polyol and dicarboxylic acid for the production of the improved lubricants of this invention. From 0.1 to 2 equivalents of the hindered polyol can be employed per equivalent of the natural fat or oil. More typically, 0.1 to 0.9 equivalent hindered polyol per equivalent triglyceride is used. Similarly, the amount of dicarboxylic acid will range from 0.1 to 2 equivalents and, more preferably, from 0.1 to 0.9 equivalent per equivalent of the triglyceride. It is not necessary that "balanced" systems, i.e. the number of equivalents of hindered polyol be the same as the equivalents of dicarboxylic acid, be used; "unbalanced" systems are equally useful and often provide advantageous results.

Prereaction of the triglyceride with the hindered polyol and dicarboxylic acid is carried out in accordance with established condensation and exchange procedures. While the prereaction may be carried out in a stepwise manner, it is more usually and advantageously conducted in a single step. It is customary to charge all of the reactants to the reaction vessel and then heat the mixture while removing water or, where a dicarboxylic acid ester is employed, alcohol. The temperature is generally maintained between about 175° C. to 250° C. and, more preferably, between 190° C. and 225° C. The reaction is maintained at an elevated temperature until the desired acid value (AV) and hydroxyl value (OHV) are obtained. To facilitate the prereaction, water/alcohol generated during the reaction is removed using a suitable condenser/trap arrangement. While the use of reduced pressure is not necessary it is advantageous, especially in the latter stages of the reaction, to pull a vacuum on the system if low AV and OHV products are desired. This facilitates removal or water/alcohol and drives the reaction forward. Catalysts, while not essential, are usually desirable to speed the rate of reaction. The amount and type of catalyst can be widely varied and any of the known catalysts such as tetrabutyl titanate, zinc acetate, sodium carbonate, sodium sulfate, stannous oxalate, p-toluene sulfonic acid, methane sulfonic acid, sulfuric acid, phosphoric acid and the like may be used. The amount of catalyst will generally range between about 0.01% and 1% by weight and, more usually, between about 0.03% and 0.5% of the reactant charge. A diluent or solvent which is inert to the reaction conditions and preferably capable of forming an azeotrope with water, such as toluene or xylene, can be employed to facilitate water removal but is not necessary.

The prereaction is continued until the AV of the mixture is 20 or less and, more preferably, less than 15. As previously pointed out, the resulting composition is a complex mixture of a variety of ester products resulting from interchange and condensation reactions. The resulting products typically have an OHV of 25 or below and SV at least 10% higher than that of the starting natural fat or oil. More usually the SV of the prereacted triglyceride is 20% or more higher than the SV of the original (unreacted) triglyceride. The increased polarity of the resulting lubricants, as evidenced by the higher SV's, is believed to at least partially account for the improved lubricity of the products. The viscosity of the prereacted triglyceride is also typically higher than that of the original fat/oil and is also believed to contribute to the enhanced lubrication properties. In a totally unexpected development, it has been discovered that inspite of the prereaction, which increases the molecular weight of the triglyceride, in most cases the resulting lubricants are significantly more volatile than the original triglyceride. This is contrary to what one would normally expect, i.e., as the molecular weight increases the vapor pressure viz. volatility decreases. This reduction in volatility is significant since it generally translates to improved burn off of the lubricant during annealing of cold rolled steel.

The prereacted fats and oils are excellent lubricants for both ferrous and non-ferrous metals and can be used for a wide variety of lubricating applications. They can comprise the sole lubricant of a lubricating formulation or they may be used in combination with one or more other lubricant products - natural, synthetic or derived from petrochemical sources. If they are one of the components in a lubricant composition, the prereacted fat or oil may be the major or a minor component of the blend. The blends can contain from 0.1% to 99.9% of the reacted triglyceride and from 99.9% to 0.1% conventional triglyceride or hydrocarbon oil. More usually the blends will contain from 5% to 95% reacted fat or oil and 95% to 5% conventional triglyceride or hydrocarbon oil. The lubricants of this invention or blends thereof can be used neat or with a suitable carrier or diluent in which they are soluble, emulsifiable or dispersible. The prereacted fats/oils are commonly blended with a suitable solvent, carrier, or base oil which in addition to serving as a diluent also imparts desirable properties to the lubricant formulation. Typically, hydrocarbon oils which are synthetically produced or which are obtained from the distillation of petrochemical products are used for this purpose. Hydrocarbon oils, both napthenic and paraffinic, having 100° F. viscosities up to about 1000 SUS and, more preferably, from 40 SUS to 500 SUS. Representative hydrocarbon oils include mineral oil, mineral seal oil, kerosene, gas oil, polyalphaolefins, and the like. The products may also be formulated with synthetic esters and additives such as stabilizers, fungicides, bacteriocides corrosion inhibitors, wetting agents and the like to enhance their performance in the widely diverse application areas where they find utility.

Due to their ready compatibility with water and other desirable characteristics, the prereacted triglycerides of this invention find particular utility in aqueous metalworking fluids formulated for ferrous metals where in addition to lubrication a high degree of cooling is desired. Aqueous lubricant systems of this type, which include dispersions and emulsions, are used in rolling, forging, casting, cutting, grinding, stamping, extruding and drawing operations. Rolling oil formulations are probably the single most important application for aqueous metalworking lubricants due to the large volume of product used in rolling operations.

Metalworking lubricant compositions, particularly rolling oil formulations, useful in aqueous systems are obtained by the addition of a suitable emulsifying or dispersing agent and one or more additives to impart the desired characteristics to the fluid. These formulated compositions may be based on the reacted triglyceride by itself or the above-described blends of the reacted triglyceride with a hydrocarbon oil and/or conventional fat or oil. In general, the emulsifier will be present from about 0.1% to 15% and, more preferably, from 0.3% to 12% and will be selected from any of the conventional anionic, cationic, nonionic or amphoteric surfactants known for this purpose. As employed herein the terms emulsifier, dispersant and surfactant are used interchangeably. Additives will typically constitute from 0.1% to 20% and, more preferably, from 0.1% to 15%. All of the percentages recited above are based on the total weight of metalworking composition excluding water. The formulated metalworking lubricant composition will usually constitute from 0.5% to 25% of the aqueous dispersion or emulsion and, more preferably, 1% to 20% of the aqueous dispersion or emulsion.

The emulsifying/dispersing agents can be selected from a wide variety of known compounds. A mixture of two or more emulsifiers, which can be the same or different types, can also be advantageously used. Choice of the particular emulsifying/dispersing agent will primarily depend on the amount of water used; the prereacted triglyceride being used; whether other triglyceride and/or hydrocarbon lubricants are present; the application involved; and the characteristics required of the resulting aqueous emulsion or dispersion.

Amphoteric compounds which can be used include alkyl-β-iminodipropionate; alkyl-β-amino-propionate; fatty imidazolines and betaines, more specifically 1-coco-5-hydroxyethyl-5-carboxymethyl imidazoline; dodecyl-β-alanine; N-dodecyl-N,N-dimethyl amino acetic acid; 2-trimethyl amino lauric acid inner salts; and the like.

Representative nonionic surfactants which can be used to obtain acceptable emulsions or dispersions include ethylene oxide adducts of alcohols, polyols, phenols, carboxylic acids and carboxylic acid esters such as ethylene oxide adducts of oleyl alcohol, nonyl phenol, glycerol, sorbitol, mannitol, pentaerythritol, sorbitan monolaurate, glycerol monooleate, pentaerythritol monostearate, oleic acid, stearic acid, and the like.

Useful cationic compounds include cetyl pyridinium bromide, hexadecyl morpholinium chloride, dilauryl triethylene tetramine diacetate, didodecylamine lactate, 1-amino-2-heptadecenyl imidazoline acetate, cetylamine acetate, oleylamine acetate, ethoxylated tallow, coco, stearyl, oleyl or soya amine, and the like. Useful anionic compounds include alkali metal salts of petroleum sulfonic acids, alkali metal salts of fatty acids, amine and ammonium soaps of fatty acids, alkali metal dialkyl sulfosuccinates, sulfated oils, sulfonated oils, alkali metal alkyl sulfates, and the like.

Cationic emulsifiers and nonionic emulsifiers and mixtures thereof are particularly effective dispersants/emulsifiers for the formulation of rolling oils. Cationic emulsifiers are generally employed at levels ranging from 0.1% to 4% and, more preferably, from 0.25% to 2% whereas nonionic emulsifiers typically are used at levels from 1% to 15% and, more preferably, from 2% to 10%.

A variety of additives can be included in the metalworking fluid to improve the quality of the fluid and/or enhance performance properties. These include but are not limited to EP additives, corrosion inhibitors, antiwear agents, metal deactivators, defoamers, anti-rust agents, deodorants, dyes, fungicides, bacteriocides, antioxidants, emulsion or dispersion stabilizers and the like. These additives and their function in formulated lubricants are well known in the industry and widely reported in the literature.

In still another embodiment of this invention the natural fat or oil after being reacted with the hindered polyol and the dicarboxylic acid is chlorinated, sulfurized (sulfurated) or chlorosulfurized (sulfurchlorinated). The prereacted triglycerides can contain from about 2% to 20% chlorine and/or sulfur and are effective additives to metalworking formulations based on the prereacted products of this invention or based on conventional triglycerides. More commonly the prereacted triglycerides will contain from 4% to 15% sulfur and/or 4% to 15% chlorine. Chlorination, sulfurization and sulfur-chlorination of the prereacted triglyceride can be accomplished in accordance with known procedures described in the prior art. These products are added to metalworking lubricant formulations to enhance the EP properties. They can be employed as one of the additives in formulations such as those recited above and can also be employed as EP additives in greases.

The following examples illustrate the invention more fully, however, they are not intended as a limitation on the scope thereof. In the examples, all parts and percentages are on a weight basis unless otherwise indicated.

EXAMPLE I

A glass reactor equipped with a stirrer, thermometer, nitrogen inlet and water-trap connected to a condenser was charged with 495 grams (1.7 equivalents) white grease having an IV of 62 and SV of 197, 26.6 grams (0.51 equivalent) neopentyl glycol, 37.2 grams (0.51 equivalent) adipic acid and 0.56 grams p-toluene sulfonic acid catalyst. The equivalents ratio of the respective reactants was 1:0.3:0.3 and the catalyst level was 0.1% of the reactant charge. The reaction mixture was heated to 200°-210° C. for 6 hours while removing water of reaction. A vacuum was then gradually applied to the system up to a maximum of 0.5 mm/Hg. After about 8 hours (total reaction time) during which time about 9 grams water was removed from the reaction mixture, heating was terminated and the vacuum broken. After cooling to 110° C. the reaction mixture was filtered using 0.5% diatomaceous earth filtering aid. Properties of the resulting product are tabulated below and, in order to show the improvement obtained, compared with the unmodified white grease.

| | Reaction Product of Ex I | White Grease |
|---|---|---|
| AV | 14 | 8 |
| OHV | 17 | 7 |
| SV | 225 | 197 |
| Viscosity (SUS) | | |
| 212° F. | 62 | 54 |
| 100° F. | 292 | 206 |

It is apparent from the above data that the saponification value and viscosity are significantly increased as a result of reaction with the hindered polyol and dicarboxylic acid. Such increases generally result in enhanced lubricity. To demonstrate this improvement, the products were evaluated using a Falex machine. This machine is commonly used by the industry to evaluate the effectiveness of metalworking lubricants since it provides a convenient and reliable means for determining the film strength and load-carrying properties of lubricants under extreme pressures. The test was conducted on the neat oil in accordance with ASTM test procedure D 3233-73. In the test, 60 grams of the oil was placed in a cup positioned so that the pin and block assembly was completely immersed in the sample. After a 5 minute break in period at 300 lbs., the ratchet was engaged to increase the load until failure i.e. either the shear pin or the Falex pin breaks. The higher the loading which can be applied before failure the more effective the lubricant. Using the unmodified white grease failure occurred at only 1950 pounds whereas with the modified product of this invention it was possible to reach 2450 pounds before failure.

While the viscosity and lubricity of the white grease which has been reacted with the hindered polyol and dicarboxylic acid are significantly increased, this is unexpectedly accomplished without adversely affecting the ability of the product to be burned off during annealing. In fact, inspite of the higher molecular weight species which are formed during the reaction, the modified grease quite surprisingly has improved volatility over the unmodified natural triglyceride. This is apparent from thermal gravimetric analysis (TGA) of the products. For this test, a Perkin-Elmer 7 Series Thermal analyzer was employed. Samples (25–30 mg.) were heated at a rate of 10° C./min. in a nitrogen flow (26 cc/min.) up to a temperature of 550° C. and held for two minutes. Weight loss of the sample was recorded. A temperature of 540° C. was required for 100% weight loss of the white grease. The modified white grease of this invention was, however, completely volatilized (100% weight loss) at 500° C. This is significant since rolling oil residues on steel can produce staining during annealing.

To further demonstrate the suitability of the products of this invention, an anneal test was performed. In this test a hexane solution containing 10% (by volume) of the product were prepared. Test panels (4"×6" uncoated, unpolished cold roll steel obtained from Advanced Coating Technology) were dipped into the hexane solution and then allowed to air dry. A five panel stack was made using three of the treated panels and two untreated panels—using the untreated panels as an interleaf. The stack was banded and heated at 1500° F. in a production anneal furnace under nitrogen containing a controlled amount of HX gas (a mixture of hydrogen, methane, carbon monoxide and carbon dioxide). After 7–10 days the panels were visually inspected for stain and completeness of burn-off. Staining of the panels treated with the product of this example was judged to be very light to light, which is acceptable.

EXAMPLE II

The procedure of Example I was repeated using palm oil (IV 50; SV 201; OHV 6). The reactant charge employed was 492 grams palm oil, 27.4 grams neopentyl glycol and 38.3 grams adipic acid (equivalents ratio of 1:0.3:0.3). Stannous oxalate (0.1%) was employed as the catalyst. Total reaction time was 6 hours during which 9 grams water was collected. The resulting product had the following properties:

| | |
|---|---|
| AV | 12.1 |
| OHV | 15 |
| SV | 221 |
| Viscosity (SUS) | |
| 212° F. | 62 |
| 100° F. | 290 |
| 100% Weight Loss by TGA (°C.) | 445 |
| Falex (lbs. at failure) | 2500 |

This is a significant improvement over unmodified palm oil which has 212° F. and 100° F. viscosities of 55 SUS and 217 SUS, respectively. Furthermore, unreacted palm oil must be heated to 455° C. to be completely volatilized (100% weight loss) by TGA and fails at only 2000 lbs. in the Falex lubricity test.

To demonstrate the ability to vary the ratio of reactants and thus vary the properties of the product, palm oil was reacted with neopentyl glycol and adipic acid in a related experiment at an equivalents ratio of 1:2:2. The AV of the product was 20.6, the SV of the oil was increased to 286 and the 100° F. viscosity was increased to 1195 SUS. The product was an effective lubricant and gave acceptable results in the anneal test. In the TGA volatility evaluation, the product was completely volatilized at 440° C.

EXAMPLE III

Following the general procedure of Example I, the reaction was repeated using canola oil (IV 110; SV 192; OHV 3). For this reaction 496 grams canola oil, 26.6 grams neopentyl glycol, 37.2 grams adipic acid and 0.56 grams (0.1 wt. %) stannous oxalate were charged to the reactor. This represents an equivalents ratio of reactants of 1:0.3:0.3. The total reaction time was 10 hours. The resulting essentially colorless product obtained after filtration had an AV of 14.2, OHV of 19 and SV of 214. 212° F. and 100° F. viscosities of the product were 59 SUS and 249 SUS, respectively, compared to unreacted canola oil which has a 212° F. viscosity of 54 SUS and 100° F. viscosity of 180 SUS. The canola oil reacted with the neopentyl glycol and adipic acid also exhibited markedly superior lubricity in the Falex test versus unmodified canola oil - 2000 lbs. at failure compared to only 900 lbs. with the conventional triglyceride oil. All of this was accomplished while increasing the volatility. Complete volatilization (100% weight loss) by TGA required 465° C. for conventional canola whereas after reaction in accordance with the present invention 100% weight loss was obtained at 460° C.

EXAMPLE IV

To demonstrate the versatility of the present invention a series of products based on canola oil were prepared following the procedure of Example III varying the equivalents ratio of canola oil, neopentyl glycol and adipic acid. Acid values, saponification values, viscosities and TGA results, where determined, are set forth in Table I. All of the products are effective metalworking lubricants and are readily compatible with water so that they can be formulated into rolling oils.

TABLE I

| Product No. | IVA | IVB | IVC | IVD | IVE | IVF |
|---|---|---|---|---|---|---|
| Equivalents Ratio (canola oil:neopentyl glycol:adipic acid) | 1:.1:.1 | 1:.5:.5 | 1:.7:.7 | 1:.9:.9 | 1:.3:.2 | 1:.2:.3 |
| AV | 12.2 | 17.8 | 15.1 | 18 | 13.7 | 20 |
| SV | 197 | 214 | 223 | 231 | 211 | 212 |
| Viscosity (SUS) | | | | | | |
| 212° F. | 56 | 62 | 69 | 76 | 58 | 60 |
| 100° F. | 203 | 290 | 356 | 435 | 306 | 256 |
| 100% Weight Loss by TGA (°C.) | 465 | 465 | * | 455 | 455 | 455 |

*Not Determined

EXAMPLE V

Additional products were prepared by reacting canola oil with different hindered polyols and methyl esters of mixed shortchain fatty acids. All reactions were carried out in accordance with the procedure previously described at an equivalents ratio of 1:0.3:0.3 (oil:hindered polyol:methyl esters). The mixed methyl ester product was a commercially available material obtained as a by-product from the manufacture of adipic acid and was comprised of dimethyl esters of mixed dicarboxylic acids comprised as follows: 16.5% $C_4$; 66% $C_5$; and 17% $C_6$. Acid values, saponification values, 100° F. viscosities and TGA results are provided in Table II. The hindered polyol employed for each product is also identified. The products obtained using the methyl esters and different hindered polyols are useful metalworking lubricants.

EXAMPLE VI

A reacted canola oil based product as prepared in Example III (1 equivalent canola oil: 0.3 equivalent neopentyl glycol: 0.3 equivalent adipic acid) was reacted with sulfur to provide a useful sulfurized product. For the reaction 275 grams of the modified canola oil was combined with 33 grams sulfur and 2.75 grams zinc oxide and heated to 160° C. under nitrogen with stirring for 7 hours. The temperature was then raised to 185° C. and heating continued for 3 hours. The mixture was then cooled, dissolved in trichloroethane with some diatomaceous earth filter aid and filtered. The product recovered after removal of the trichloroethane was black and contained 9.24% sulfur by analysis. The product had a 100° F. viscosity of 1977 SUS and is an effective additive for metalworking formulations. Copper corrosion determined in accordance with ASTM test procedure D-130 was 1B indicating the presence of non-active sulfur.

The experiment was repeated except that the sulfurization was carried out to a slightly lower level. The resulting viscous product contained 8.94% sulfur and had a viscosity (100° F.) of 2798 SUS. The product had a rating of 1A in the copper corrosivity test.

TABLE II

| Product No. Hindered Polyol Used: | VA Neopentyl Glycol | VB Trimethylol Propane | VC Pentaerythritol |
|---|---|---|---|
| AV | 1.8 | 1.7 | 1.6 |
| SV | 216 | 218 | 210 |
| 100° F. Viscosity (SUS) | 162 | 194 | 189 |
| 100% Weight Loss by TGA (°C.) | 460 | 460 | 465 |

EXAMPLE VII

A series of modified triglycerides were prepared similar to Example IV except that palm oil was used. The equivalent ratio of reactants and properties of the resulting reacted products are provided in Table III.

EXAMPLE VIII

Useful metalworking compositions for aqueous systems were prepared in accordance with the following recipes:

| Product No. | VIIIA | VIIIB | VIIIC |
|---|---|---|---|
| Product of Ex. I | 95 | 47 | 30 |
| White Grease | — | 48 | 35 |
| Naphthenic Oil (100 SUS) | — | — | 30 |
| Nonionic Emulsifier | 5 | 5 | 5 |

Amounts of ingredients are given in parts and the emulsifier used was a mixture of an ethoxylated nonylphenol and an ethoxylated alcohol. The products were all readilly emulsifiable in water. To demonstrate the utility of the resulting aqueous systems for metalworking, an emulsion containing 5% of each product was evaluated using the previously described Falex test procedure with the following results:

| | Pounds at Failure |
|---|---|
| Aqueous Emulsion containing 5% VIIIA | 3900 |
| Aqueous Emulsion containing 5% VIIIB | 3750 |
| Aqueous Emulsion containing 5% VIIIC | 3200 |

All of the emulsions provided effective lubrication.

TABLE III

| Product No. | VIIA 1:.1:.1 | VIIB 1:.5:.5 | VIIC 1:.7:.7 | VIID 1:.9:.9 |
|---|---|---|---|---|
| Equivalents Ratio (palm oil:neopentyl glycol:adipic acid) | | | | |
| AV | 7.4 | 15.8 | 15.2 | 18 |
| SV | 205 | 223 | 232 | 241 |
| OHV | 16 | 20 | 20 | 21 |
| Viscosity (SUS) | | | | |
| 212° F. | 52 | 74 | 67 | 79 |
| 100° F. | 184 | 365 | 440 | 514 |
| 100% Weight Loss by TGA (°C.) | 455 | 440 | * | 440 |

*Not Determined

EXAMPLE IX

Similar to the preceding example, a metalworking composition was formulated to contain 65% Product of Ex. II, 31% naphthenic oil (100 SUS), 2% nonionic emulsifier (ethoxylated nonylphenol), and 2% cationic emulsifier (ethoxylated tallow amine). A 5% aqueous emulsion prepared with the product achieved 3700 pounds before failure in the Falex test.

EXAMPLE X

Fully formulated rolling oil composition were prepared in accordance with the following recipes:

| | Parts |
|---|---|
| Product of Ex. III | 17.4 |
| White Grease | 69.6 |
| Cationic Emulsifier | 2 |
| Buffering Agent | 3 |
| Antioxidant | 0.2 |
| EP Additive | 1 |
| Sulfurized (10% S) Lard | 6.8 |
| Product of Ex. III | 43.5 |
| White Grease | 43.5 |
| Cationic Emulsifier | 2 |
| Buffering Agent | 3 |
| Antioxidant | 0.2 |
| EP Additive | 1 |
| Sulfurized (10% S) Lard | 6.8 |
| Product of Ex. III | 17.4 |
| White Grease | 69.6 |
| Cationic Emulsifier | 2 |
| Buffering Agent | 3 |
| Antioxidant | 0.2 |
| EP Additive | 1 |
| Product of Ex. VI (9.24% S) | 6.8 |

All of the above products were readily emulsifiable with water and aqueous emulsions containing 5% of the products were effective metalworking fluids and useful as rolling oils for cold rolling steel.

I claim:

1. An improved metalworking lubricant having an acid value of 20 or less and hydroxyl value of 25 or less comprising the reaction product of:

(a) a natural fat or oil having an iodine value from 5 to 150, a saponification value from 170 to 265 and which is substantially free of hydroxy or keto functionality;

(b) 0.1 to 2 equivalents, per equivalent of the natural fat or oil, of a hindered polyol having from 5 to 15 carbon atoms and 2 to 8 hydroxyl groups; and (c) 0.1 to 2 equivalents, per equivalent of the natural fat or oil, of a dicarboxylic acid having from 2 to 36 carbon atoms or a lower alkyl ester thereof.

2. The improved metalworking lubricant of claim 1 which has an acid value less than 15 and saponification value which is at least 10% greater than that of (a).

3. The improved metalworking lubricant of claim 1 wherein (a) has an iodine value from 10 to 130, saponification value from 175 to 210 and polyunsaturates content of 40% or less.

4. The improved metalworking lubricant of claim 3 wherein (b) contains 5 or 6 carbon atoms and 2 to 4 hydroxyl groups and (c) is an aliphatic dicarboxylic acid having from 2 to 12 carbon atoms or lower alkyl ester thereof.

5. The improved metalworking lubricant of claim 4 wherein the equivalents ratio of (a): (b): (c) is 1:0.1–0.9:0.1–0.9.

6. The improved metalworking lubricant of claim 5 wherein (a) is selected from the group consisting of white grease, tallow, lard, canola oil, palm oil, palm kernel oil, peanut oil, olive oil, neatsfood oil and cottonseed oil and (b) is selected from the group consisting of neopentyl glycol, trimethylol ethane, trimethylol propane and pentaerythritol.

7. The improved metalworking lubricant of claim 6 wherein (c) is an aliphatic dicarboxylic acid having from 4 to 10 carbon atoms or methyl ester thereof.

8. The improved metalworking lubricant of claim 6 wherein (c) is a mixture of methyl esters of predominantly $C_{4-6}$ aliphatic dicarboxylic acids.

9. The improved metalworking lubricant of claims 1, 2, 3, 4, 5, 6, 7 or 8 which is chlorinated to a chlorine content of from 2% to 20% or sulfurized or chlorosulfurized to a sulfur content of from 2% to 20%.

10. The improved metalworking lubricant of claim 9 which is sulfurized to a level of from 4% to 15% sulfur.

11. A process for improving the lubricity of a natural fat or oil which comprises reacting (a) a natural fat or oil having an iodine value from 5 to 150, saponification value from 170 to 265 and which is substantially free of hydroxy or keto functionality (b) 0.1 to 2 equivalents, per equivalent of the natural fat or oil, of a hindered polyol having from 5 to 15 carbon atoms and 2 to 8 hydroxyl groups, and (c) 0.1 to 2 equivalents, per equivalent of the natural fat or oil, having from 2 to 36 carbon atoms or a lower alkyl ester thereof at a temperature from 175°° C. to 250° C. while removing water/alcohol until the acid value is 20 or below, the hydroxyl value is 25 or below and the saponification value is at least 10% higher than that of (a).

12. The process of claim 11 wherein (a) has an iodine value from 10 to 130, saponification value from 175 to 210 and polyunsaturates content of 40% or less, (b) contains 5 or 6 carbon atoms and 2 to 4 hydroxyl groups, and (c) is an aliphatic dicarboxylic acid having from 2 to 12 carbon atoms or lower alkyl ester thereof.

13. The process of claim 12 wherein the temperature is 190° C. to 225° C. and the equivalents ratio of (a):(b):(c) is 1:0.1–0.9:0.1–0.9.

14. The process of claim 13 wherein the acid value is less than 15 and the saponification value is 20% or more higher than that of (a).

15. The process of claim 14 wherein (a) is selected from the group consisting of white grease, tallow, lard, canola oil, palm oil, palm kernel oil, peanut oil, olive oil, neatsfoot oil and cottonseed oil, (b) is selected from the group consisting of neopentyl glycol, trimethylol ethane, trimethylol propane and pentaerythritol, and (c) is an aliphatic dicarboxylic acid having from 4 to 10 carbon atoms or methyl ester thereof.

16. A metalworking lubricant composition comprising (1) a metalworking lubricant which is the reaction product of:

(a) a natural fat or oil having an iodine value from 5 to 150, a saponification value from 170 to 265 and which is substantially free of hydroxy or keto functionality;

(b) 0.1 to 2 equivalents, per equivalent of the natural fat or oil, of a hindered polyol having from 5 to 15 carbon atoms and 2 to 8 hydroxyl groups; and (c) 0.1 to 2 equivalents, per equivalent of the natural fat or oil, of a dicarboxylic acid having from 2 to 36 carbon atoms or a lower alkyl ester thereof, said lubricant having an acid value less than 20, hydroxyl value less than 25, and saponification value which is at least 10% greater than that of (a);

(2) 0.1% to 15% anionic, cationic, nonionic or amphoteric emulsifier; and (3) 0.1% to 20% additives.

17. The metalworking lubricant composition of claim 16 wherein for (1) (a) has an iodine value from 10 to 130, saponification value from 175 to 210 and polyunsaturates content of 40% or less, (b) contains 5 to 6 carbon atoms and 2 to 4 hydroxyl groups, (c) is an aliphatic dicarboxylic acid having from 2 to 12 carbon atoms or lower alkyl ester thereof, and (1) has an acid value less than 15 and saponification value 20% or more higher than that of (a).

18. The metalworking lubricant composition of claim 17 wherein (2) is present from 0.3% to 12% and is cationic emulsifier or nonionic emulsifier or mixture thereof and (3) is present from 0.1% to 15%.

19. The metalworking lubricant composition of claim 18 wherein for (1) (a) is selected from the group consisting of white grease, tallow, lard, canola oil, palm oil, palm kernel oil, peanut oil, olive oil, neatsfoot oil and cottonseed oil, (b) is selected from the group consisting of neopentyl glycol, trimethylol ethane, trimethylol propane and pentaerythritol, and (c) is an aliphatic dicarboxylic acid having from 4 to 10 carbon atoms or methyl ester thereof.

20. The metalworking lubricant composition of claim 16, 17, 18 or 19 which is combined with water to provide an aqueous metal working fluid.

21. The metalworking lubricant composition of claim 20 which contains 0.5% to 25% of the metalworking lubricant composition.

22. A metalworking lubricant composition comprising (1) 0.1% to 99.9% metalworking lubricant which is the reaction product of:

(a) a natural fat or oil having an iodine value from 5 to 150, a saponification value from 170 to 265 and which is substantially free of hydroxy or keto functionality;

(b) 0.1 to 2 equivalents, per equivalent of the natural fat or oil, of a hindered polyol having from 5 to 15 carbon atoms and 2 to 8 hydroxyl groups; and (c) 0.1 to 2 equivalents, per equivalent of the natural fat or oil, of a dicarboxylic acid having from 2 to 36 carbon atoms or a lower alkyl ester thereof, said lubricant having an acid value less than 20, hydroxyl value less than 25, and saponification value which is at least 10% greater than that of (a); and (2) 0.1% to 99.9% of a natural fat, natural oil, or hydrocarbon oil having a viscosity up to 1000 SUS at 100° F.

23. The metalworking lubricant composition of claim 22 wherein for (1) (a) has an iodine value from 10 to 130, saponification value from 175 to 210 and polyunsaturates content of 40% or less, (b) contains 5 or 6 carbon atoms and 2 to 4 hydroxyl groups, (c) is an aliphatic dicarboxylic acid having from 2 to 12 carbon atoms or lower alkyl ester thereof, and (1) has an acid value less than 15 and saponification value 20% or more higher than that of (a) and (2) is selected from the group consisting of white grease, tallow, lard, canola oil, palm oil, palm kernel oil, peanut oil, olive oil, neatsfoot oil, cottonseed oil, mineral oil, mineral seal oil, kerosene oil, gas oil and polyalphaolefins.

24. The metalworking lubricant composition of claim 23 which additionally contains (3) 0.1% to 15% anionic, cationic, nonionic or amphoteric emulsifier and (4) 0.1% to 20% additives.

25. The metalworking lubricant composition of claim 24 wherein (1) is present from 5% to 95%, (2) is present from 5% to 95%, (3) is present from 0.3% to 12% and is a cationic emulsifier or nonionic emulsifier or mixture thereof and (4) is present from 0.1% to 15%.

26. The metalworking lubricant composition of claim 25 wherein for (1) (a) is selected from the group consisting of white grease, tallow, lard, canola oil, palm oil, palm kernel oil, peanut oil, olive oil, neatsfoot oil and cottonseed oil, (b) is selected from the group consisting of neopentyl glycol, trimethylol ethane, trimethylol propane and pentaerythritol, and (c) is an aliphatic dicarboxylic acid having from 4 to 10 carbon atoms or methyl ester thereof.

27. The metalworking lubricant composition of claim 22, 23, 24, 25 or 26 which is combined with water to provide an aqueous metal working fluid.

28. The metalworking lubricant composition of claim 27 which contains 0.5% to 25% of the metalworking lubricant composition.

* * * * *